United States Patent [19]

Cappelletto et al.

[11] 4,291,379

[45] Sep. 22, 1981

[54] METHOD AND AN INSTALLATION FOR REGENERATING MOLDING SANDS

[76] Inventors: Renzo Cappelletto, 57 rue de Foussard, Tavers, 45190 Beaugency; Jean Willame, 66 avenue de Ferrière, 59131 Rousies, both of France

[21] Appl. No.: 90,449

[22] Filed: Nov. 1, 1979

[30] Foreign Application Priority Data

Nov. 10, 1978 [FR] France ..... 78 31830

[51] Int. Cl.[3] ..... G06F 15/46

[52] U.S. Cl. ..... 364/506; 364/472

[58] Field of Search ..... 364/506, 472; 164/5; 177/114; 366/17, 18

[56] References Cited

U.S. PATENT DOCUMENTS

| | | | |
|---|---|---|---|
| 3,168,926 | 2/1965 | Dietert | 177/114 |
| 3,373,977 | 3/1968 | Dietert | 366/18 X |
| 3,561743 | 2/1971 | Schroeder et al. | 364/477 X |
| 3,627,021 | 12/1971 | Schultz et al. | 364/472 X |
| 4,149,581 | 4/1979 | Adkison et al. | 164/5 |

OTHER PUBLICATIONS

Automatic Sand Testing and Bond Additions to System Sand; Dietert, Modern Castings, vol. 52, No. 6, Dec. 1967, pp. 61–67.

Computerized Sandology for Instant Sand Control; Schaum; Modern Castings, vol. 57, No. 3, Mar. 1970, pp. 131–133.

Improve Your Core Mixtures with a Computer; Smith, et al., Modern Castings, vol. No. 1, Jan. 1967, pp. 59–63.

*Primary Examiner*—Edward J. Wise

*Attorney, Agent, or Firm*—Young & Thompson

[57] ABSTRACT

The method for automatically regenerating molding sands consists in mixing the spent sand and in intermittently withdrawing a cylindrical test sample of sand. The compactibility of the test sample is measured intermittently by determining the reduction in height of the sample under the action of a predetermined force. The quantity of water to be added to the sand is determined by means of a microprocessor from the result of the measurement and from the temperature of the sample. The results of measurements of compactibility and compressive strength of the test sample are transmitted to the microprocessor which determines the quantity of bentonite, of foundry black and the like to be added to the spent sand.

4 Claims, 3 Drawing Figures

METHOD AND AN INSTALLATION FOR REGENERATING MOLDING SANDS

This invention relates to a method for regenerating the molding sands employed in foundry practice.

The invention is also directed to an installation for the practical application of said method.

It is known that metal castings are formed in molds made from bentonite-bonded sands. These molding sands are also mixed with an additive known as foundry black, which is a carbonaceous product used as an anti-oxidant. At the time of pouring of the metal into molds of this type, said molds are brought to a high temperature, thus resulting in irreversible chemical conversion of part of the bentonite and of the foundry black, with the result that the sand can no longer be directly employed for the preparation of other molds. It is consequently necessary to regenerate this molding sand by adding predetermined quantities of water, bentonite and foundry black or a similar product. This regeneration takes place in units such as grinding mills, pug mills or mixers which are supplied with sand to be recycled, either continuously or in successive charges which are suited to the capacity of the unit. These machines make it possible to regenerate the molding sand in order to make it suitable for the molding process by mixing the different constituent elements with this latter as intimately as possible.

The physical characteristics of molding sands which have been regenerated in units of the type mentioned above are essentially dependent on the degrees of regeneration of the constituent elements of the sand and more especially of the water and the bentonite but also on the efficiency of the treatment to which they are subjected. The percentage values of incorporation of these essential elements depend on the characteristics of the sand to be regenerated which are influenced by a large number of factors including the characteristics of the sand prior to casting, the casting temperature, the time of cooling of the metal within the sand mold, the volume and the surface area of castings, the weight and nature of cores, the time of cooling of the sand, the volume of sand in the sand-hopper and the frequency of changes of production.

Under these conditions, it is very difficult to determine beforehand the quantities of bentonite and water to be incorporated in the sand at each regenerating operation. In practice, the usual procedure therefore calls for the presence of an operator who tests the sand by hand during the preparation and incorporates the additives (water, bentonite and foundry black) according to the general impression gained from the "feel" of the sand. When the foundry is equipped with a sand analysis laboratory, the results of these analyses are communicated periodically to the operator in order to limit errors of appreciation. The consistency of the results thus obtained is very unreliable and a certain number of appliances have accordingly been devised with a view to overcoming this drawback. In the very great majority of instances, these appliances make it possible to adjust the proportion only of water or of sand whilst the bentonite content is adjusted solely as a function of tests performed in the laboratory. Up to the present time, these appliances have not proved satisfactory in a single instance, the essential reasons for this being as follows:

in the first place, it is very difficult to determine rapidly the water content of the molding sand within a temperature range of 15° C. to 90° C.;

in the second place, the water content which is necessary to make a sand suitable for molding varies continuously as a function of all the constituent elements of the sand, with the result that no useful purpose is served by attempting to adjust said water content.

Another known method consists in measuring the physical properties of cylindrical samples taken from the spent sand and in determining with the aid of a computer the quantities of water, of bentonite, of clay and of other products to be added to the spent sand in order to regenerate this latter.

Experience has shown, however, that this method was not very reliable and gave rise to non-reproducible results.

The aim of this invention is to overcome the disadvantages mentioned above by providing a method and an installation for automatically regenerating with a high degree of efficiency the sands employed in foundries.

In the method for automatic regeneration of molding sands, the spent sand is mixed, a cylindrical test sample of sand is taken intermittently, the physical properties of said sample are determined, the results obtained are transmitted to a microprocessor which determines the quantities of water, of bentonite, of foundry black and the like to be added to the spent sand, then initiates and controls automatically the addition of said quantities to the spent sand.

In accordance with the invention, said method essentially consists in intermittently measuring the compactibility of the test sample by determining the reduction in height of the sample under the action of a predetermined force. The quantity of water to be added to the sand is determined by the microprocessor from the result of said measurement and from the temperature of the sample. The compressive strength of the test sample aforesaid is then measured. According to the results of the measurements of compactibility and compressive strength of the sample, the microprocessor then determines the quantity of bentonite, of foundry black and the like to be added to the spent sand.

It has been demonstrated by experience that the results of the above-mentioned measurements of compactibility and of compressive strength of the sand provided a very satisfactory determination of the qualities required to make the sand suitable for molding.

In view of the fact that the results of the measurements aforesaid are directly dependent on the proportions of water and of bentonite contained in the sand, it is only necessary to transmit these results to the microprocessor in order to obtain directly the necessary quantities of ingredients to be added to the sand. On the basis of the results of these calculations, the microprocessor can then directly control the introduction of water, of bentonite and of foundry black in the sand to be regenerated.

The invention is also directed to an installation for automatically regenerating the molding sands employed in foundries. This installation comprises a pug mill which is intended to receive the spent sand, means whereby a cylindrical test sample of sand is withdrawn automatically and intermittently, means for determining the physical properties of said test sample, means for transmitting the results obtained to a microprocessor which is capable of determining the quantities of water, of bentonite, of foundry black or like product to be added to the spent sand and also of controlling means for adding the above-mentioned quantities to the spent sand.

The installation aforesaid is distinguished by the fact that it comprises means for automatically and intermittently measuring the compactibility of the test sample, said means being in turn provided with means for determining the reduction in height of said sample under the action of a predetermined force. The installation further comprises a microprocessor which is capable of determining the quantity of water to be added to the sand according to the result of said measurement and the temperature of the test sample and means for automatically measuring the compressive strength of the test sample which has been subjected to said measurement. On the basis of the results of measurements of compactibility and of compressive strength of the test sample, the microprocessor is also capable of calculating the quantity of bentonite, of foundry black and/or of a like product to be added to the spent sand.

By virtue of the means for measuring the qualities of sand and of a microprocessor which are employed in conjunction with the pug mill, the process of sand regeneration is made fully automatic, thus dispensing with any arbitrary appreciation which is liable to give rise to errors.

In a preferred embodiment of the invention, the means for measuring the compactibility of a sample of molding sand comprise a cylinder in which is slidably mounted a piston actuated by a jack, means for introducing the sand to be tested into said cylinder, a cover actuated by a jack for closing the cylinder after filling this latter with sand to be tested, and a transducer for measuring the travel of the piston within the cylinder which has been filled with sand to be tested.

A measurement of the travel of said piston within the cylinder which has been filled with sand to be tested is obtained under the action of a predetermined pressure applied to the piston and determines the compactibility of the sand. On the basis of this measurement, it is possible by means of the microprocessor to determine the quantity of water which is necessary in order to regenerate the sand since said microprocessor contains in memory a mathematical relation which has been determined experimentally.

In accordance with another preferred feature, the means for measuring the compressive strength of the aforementioned sample of molding sand comprise a second piston placed externally of the cylinder and capable of displacement along the axis of said cylinder towards the first piston, the end of said second piston being fitted with a force transducer.

By means of said force transducer, it is possible to determine the force which is necessary in order to compress the sample of sand placed between the two pistons aforementioned, said sample of sand being extracted from the cylinder.

Further distinctive features and advantages of the invention will become apparent from the following description, reference being made to the accompanying drawings which are given by way of example and not in any limiting sense, and in which.

The installation according to the invention will be described first. The method according to the invention will then be described at the same time as the operation of the installation mentioned above.

Figure 1:
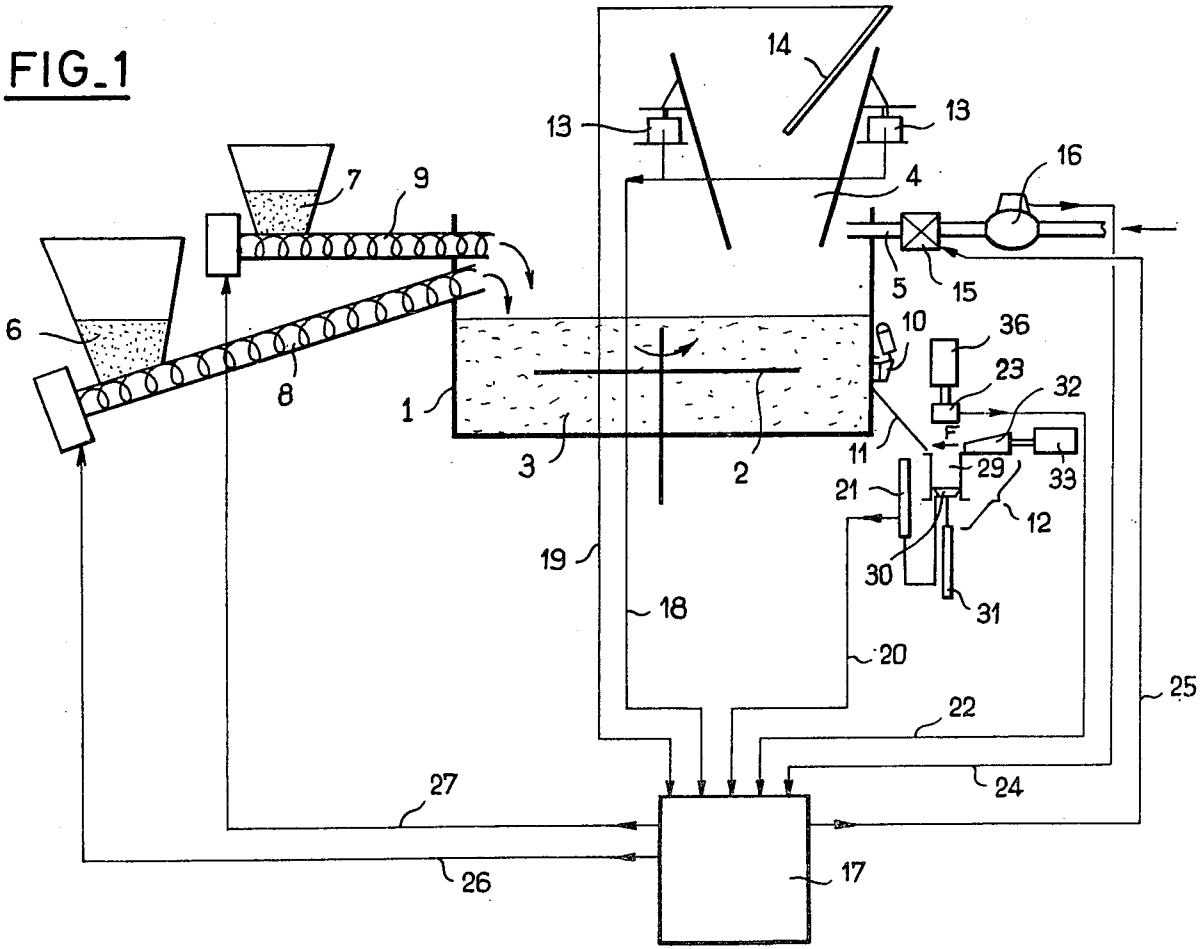
FIG. 1 is a schematic view of the installation according to the invention.

Referring to FIG. 1, the installation for regenerating the molding sand employed in a foundry comprises a pug mill 1 having a rotary mixing blade 2. Said pug mill 1 is supplied with molding sand 3 from a feed hopper 4, said sand being intended to be regenerated. The installation further comprises a pipe 5 for supplying water and means for supplying bentonite 6 and foundry black 7, said means being constituted for example by proportioning conveyors in the form of helical screws 8 and 9.

The lateral wall of the pug mill 1 is provided with a gate 10 for periodically extracting samples of sand. Said gate 10 is connected by means of an inclined chute 11 to an apparatus 12 for measuring the compactibility and compressive strength of the sand sample extracted through the gate 10 aforesaid. The detail structural design of the apparatus 12 will be described below with reference to FIGS. 2 and 3.

In the embodiment shown in FIG. 1, the hopper 4 is placed on balances 13 for weighing the sand which is introduced into the pug mill 1. Said hopper 4 further comprises a probe 14 for measuring the temperature of the sand.

Furthermore, the water supply pipe 5 is fitted with an electromagnetic valve 15, said valve being preceded by a water meter 16.

The installation according to the invention further comprises a microprocessor 17 which is connected to the different measuring instruments of the installation.

The reference 19 designates the connection established between the microprocessor 17 and the temperature probe 14; a connection 18 is also established between the microprocessor 17 and the balance 13; another connection 20 is established between the microprocessor 17 and the transducer 23 for measuring the compressive strength of said sand sample; and a connection 24 is established between said microprocessor and the water meter 16.

As will be described in greater detail with reference to the operation of the installation according to the invention, the microprocessor 17 utilizes the results of the measurements transmitted thereto by the different measuring devices via the connections mentioned earlier and is capable of controlling the operation of the valve 15 of the pipe 5 for the supply of water to the pug mill 1, the operation of the proportioning screw 8 for the supply of bentonite and the operation of the proportioning screw 9 for the supply of foundry sand. A connection 25 is accordingly provided between the microprocessor 17 and the water supply valve 15; a connection 26 is provided between the microprocessor 17 and the proportioning screw 8 for the supply of bentonite; and a connection 27 is provided between the microprocessor and the proportioning screw 9 for the supply of foundry black.

Figure 3:
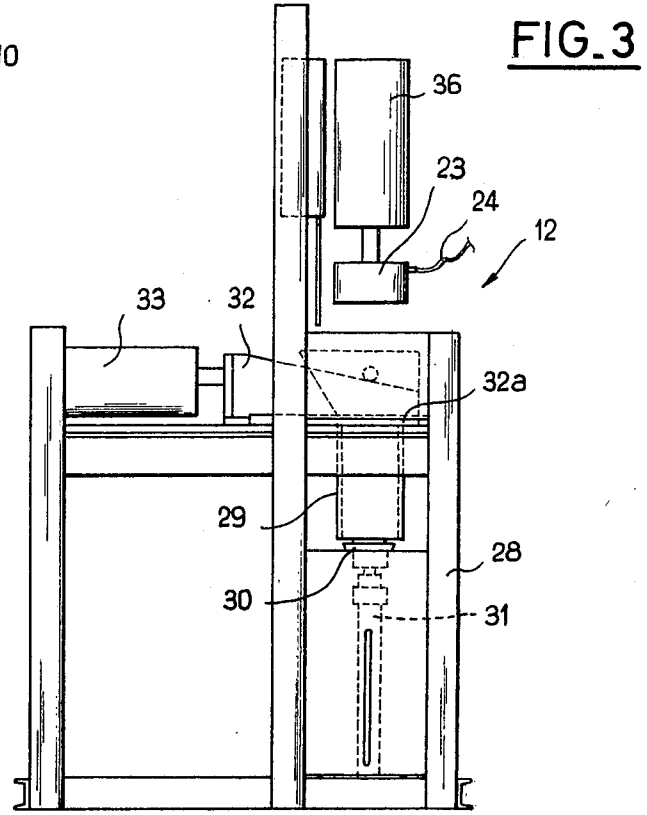
FIG. 3 is another view in elevation at right angles to the view of FIG. 2.
Figure 2:
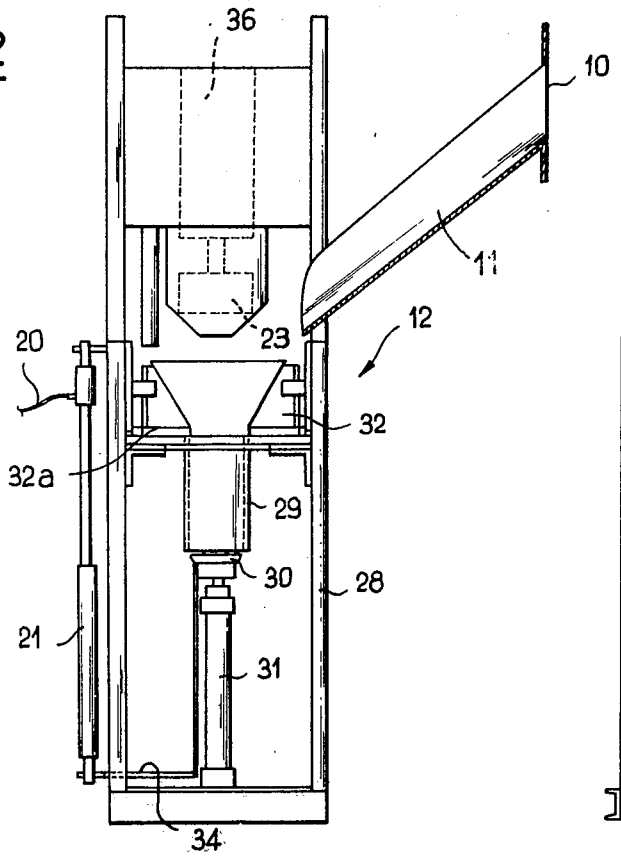
FIG. 2 is a view in elevation of the appliance for measuring the compactibility and compression strength of a sample of molding sand.

Referring to FIGS. 2 and 3, there will now be described in greater detail the apparatus 12 for measuring the compactibility and compressive strength of a sample of molding sand withdrawn through the gate 10 of the pug mill 1.

Said apparatus 12 comprises a frame 28 which is adapted to carry a cylinder 29 having a vertical axis in the service position. A piston 30 is placed beneath said cylinder 29 and capable of sliding within this latter under the action of a hydraulic jack 31.

The inclined chute 11 has its opening above the cylinder 29 and serves to direct towards this latter a sample of sand which has been withdrawn from the mixer 1 after opening of the gate 10.

The apparatus 12 is also provided with a cover 32 actuated by a pneumatic jack 33 for closing the cylinder 29 after filling of this latter with sand to be tested. Said cover 32 is capable of moving at right angles to the axis of the cylinder 29. Horizontal guides 32*a* are accordingly provided for the displacement of said cover 32 in sliding motion.

Moreover, the piston 30 is connected by means of an elbowed rod 34 to a displacement transducer 21 which serves to measure the travel of the piston 30 within the cylinder 29 and consequently determines the compactibility of the sand which has been introduced into said cylinder.

The apparatus 12 further comprises a pneumatic jack 36 which is placed above the cylinder 29 in the axis of this latter. Said pneumatic jack 36 is capable of displacement towards the cylinder 29. Said jack 36 is adapted to carry a force transducer 23 which is moved by said jack towards the cylinder 29.

The operation of the installation mentioned above will now be described at the same time as the method in accordance with the invention.

The molding sand to be regenerated is fed into the mixer 1 by means of the hopper 4. The weight of the sand fed into the mixer 1 is measured by means of the balances 13. The probe 14 which extends within the hopper 4 measures the temperature of the sand. The measurements taken by the balances 13 and the probe 14 are transmitted to the microprocessor 17 which stores them in memory.

After a short period of mixing, a sample of sand is withdrawn from the mixer 1 and introduced into the cylinder 29 by means of the chute 11. At this instant, the piston 30 is located at the lower end of the cylinder 29 as shown in FIGS. 1 to 3. After filling of the cylinder 29 with the sand to be tested, the cover 32 is displaced (in the direction of the arrow F of FIG. 1) by actuating the jack 33 in order to close the upper end of the cylinder 29.

As it carries out this movement, the cover 32 acts as a scraper which removes the excess quantity of sand. The sand contained within the cylinder 29 is then compacted against the cover 32 by the piston 30 until a predetermined pressure equal to 10 kg/cm$^2$, for example, is obtained. The travel of the piston 30 is measured by the displacement transducer 21 which transmits this information to the microprocessor 17.

The cover 32 is then open and the sample of compacted sand is then extracted from the cylinder 29 by upward displacement of the piston 30, whereupon the sample of sand is then removed. A few instants before the end of the mixer cycle, a fresh sample is withdrawn and compacted in the manner described above. Before being removed, the sample is compressed by the jack 36 against the piston 30 outside the cylinder 29 until it is finally crushed. The force required in order to attain this crushing point is measured by the force transducer 23, a signal which is proportional to said force being transmitted by said transducer to the microprocessor 17.

The results of the measurements, the temperature measured by the probe 14, the weight of the sand determined by the balance 13, the compactibility determined by the displacement transducer 21 and the compressive strength measured by the force transducer 29 are utilized by the microprocessor 17 which calculates the quantities of water, of bentonite and of foundry black to be introduced into the mixer in order to regenerate the sand for reuse.

The microprocessor 17 determines the quantity of water required by means of the following relation:

$$V=P[K(ASV-ASM)+BT]$$

In this relation, V is the volume of water, P is the weight of sand, K is a coefficient which is determined experimentally and varies substantially between 0 and 0.2 according to the nature of the sand, ASV is the contemplated degree of compactibility, ASM is the measured degree of compactibility, BT is a corrective which takes the temperature into account and usually varies between 0 and 2%. When ASM is below a predetermined value ASo, the value ASM is corrected mathematically by the microprocessor in proportion to the difference between this latter and ASo.

The microprocessor 17 determines the quantity of bentonite required by first calculating the index of cohesion Ic by means of the relation Ic=Rec/(ASM) (2) in which Rec is the compressive strength of the sand, ASM is the measured compactibility. Said index Ic is compared with the contemplated index Ic and the quantity of bentonite which is necessary and determined so as to adjust the measured index Ic to the contemplated index Ic.

The quantity of foundry black is calculated by multiplying the quantity of bentonite calculated as indicated in the foregoing by means of a predetermined constant comprised between 0 and 1.

On the basis of the aforementioned results of calculations, the microprocessor 17 delivers signals to the water meter 16 and to the electromagnetic valve 15 in order to control the introduction of the necessary quantity of water into the mixer 1. Similarly, the microprocessor 17 delivers signals to the proportioning screws 8 and 9 in order to control the introduction of suitable quantities of bentonite and of foundry black into the mixer 1.

The sand to which the aforementioned ingredients have been added is then mixed during a sufficient period of time to obtain perfect homogeneity of the different constituents. Discharge of the regenerated molding sand can be controlled automatically.

One numerical example is given hereinafter.

1000 kg of sand to be regenerated are introduced into the mixer. A sample of this sand is withdrawn and its compactibility is measured; there is thus found a value of 21% (ASM) whereas the contemplated value is 43% (ASV).

On the basis of the formula (1) given above, the microprocessor determines the quantity of water to be added to the sand. The calculation determines a quantity of 16.9 liters of water.

On completion of the mixing cycle, a further measurement of compactibility of the sand is performed while making sure that this value is in fact equal to or close to the contemplated value.

The compressive strength of the sample of sand is then measured and is found to be 1100 g/cm$^2$.

On the basis of formula (2), the microprocessor determines the cohesion index $I_c$ and the calculation results in a value of 24.58. This value is below the contemplated lower limit of 25. The microprocessor then produces an increase in the time of operation of the bentonite proportioning screw for the following mixing cycle. This increase takes place in successive steps of 10/16 seconds until the cohesion index obtained is above 25 and below 30.

The same calculation is effected for proportioning the foundry black by increasing the time of operation of the black proportioning screw by 50% of the time of operation of the bentonite proportioning screw.

As is apparent from the foregoing description, the operation of the method and the installation in accordance with the invention is fully automatic. This accordingly avoids any manual intervention which would be liable to introduce errors in the proportioning of ingredients.

The measurements effected on the sample of sand taken from the mixer are carried out very rapidly, with the result that these measurements do not interrupt the process of regeneration of the sand. The results of these measurements are transmitted directly to the microprocessor 17 which immediately initiates the addition of the necessary quantities of ingredients for regenerating the sand.

As can readily be understood, the invention is not limited to the example described in the foregoing and many modifications can accordingly be contemplated without thereby departing either from the scope or the spirit of the invention.

From this it accordingly follows that the apparatus 12 can be modified so as to provide a complete separation between the devices for measuring compactibility and the devices for measuring the compressive strength of the sand samples. The elements for controlling said apparatus 12 as well as the measuring transducers of this latter can of course be replaced by devices or transducers which perform equivalent functions provided that said transducers are capable of delivering reproducible information to the microprocessor. Similarly, the apparatus can be adapted to a continuous pug mill. In this case, the microprocessor 17 will actuate systems for adjusting the flow rates and not the volume of the different adjuvants.

The sand extraction chute 11 can further comprise a divider for aerating the extracted sand so that this latter may be in a better condition for testing by means of the apparatus 12. As will readily be apparent, the gate 10 can be replaced by any other device for removal or extraction.

In order to regulate the clay (bentonite) and the foundry black, the steps of 10/16 second can be replaced by any other steps of variable duration (see example). It is also possible to take the means value of two successive measurements and to correct the quantity of ingredients added, either by means of the system previously described or proportionally to the difference between the contemplated value $I_c$ and the measured value $I_c$.

In the particular case of continuous mixers of the type comprising a double vessel or pan, another embodiment of the invention consists in placing a single apparatus 12 for measuring the compactibility and compressive strength in the corner located between the two cylindrical vessels.

A first extraction gate 10 is placed on the first vessel into which the sand to be regenerated is admitted in a location such that a second extraction gate 10 can be placed on the second vessel at a location close to the outlet for the prepared sand.

Regulation of the flow of water in order to obtain the contemplated value of compactibility will be carried out at a high frequency of the order of 15 seconds, for example, by means of test samples withdrawn through the gate 10 of the first vessel.

Control of the final compactibility and measurement of the compressive strength for calculating the cohesion index and therefore the regulation of additions of ingredients will be carried out at a lower frequency of the order of two minutes, for example, by means of test samples withdrawn through the gate 10 of the second vessel.

What is claimed is:

1. A method for regeneration of molding sands comprising the following steps:

(a) withdrawing intermittently a cylindrical test sample of sand from a volume of mixed spent sand, (b) measuring intermittently the compactibility of said test sample by determining the reduction in height of said sample under the action of a predetermined compressive force, (c) measuring then the compressive strength of said sample, (d) determining the quantity of water which must be added to the spent sand for its regeneration by the following relation:

$$V=P[K(ASV-ASM)+BT]$$

where V is the volume of water, P is the weight of sand, K is a coefficient which varies between 0 and about 0.2 according to the nature of the sand, ASV is the contemplated degree of compactibility, ASM is the measured compactibility, BT is a correction factor for temperature and varies between 0 and about 2%, (e) determining the quantity of bentonite which must be added to the spent sand for its regeneration, by calculating an index of cohesion Ic of the sand by means of the relation: $Ic=Rec/(ASM)$, where Rec is the compressive strength of the sand, ASM is the measured compactibility, said index Ic is compared with the contemplated index Ic and the quantity of bentonite required is determined so as to adjust the measured index Ic to the contemplated index Ic, (f) adding to the spent sand a quantity of water and bentonite as determined above.

2. An installation for automatically regenerating molding sands comprising a pug mill adapted to receive the spent sand, means for automatically and intermittently withdrawing a cylindrical test sample of sand from the spent sand contained in said pug mill, means for automatically and intermittently measuring the compactibility of the test sample by determining the reduction of height of said sample under the action of a predetermined force, means for automatically measuring the compressive strength of the test sample which has been subjected to the precedent measurement, means for determining the quantity of water which must be added to the spent sand for its regeneration by the following relation:

$$V=P[K(ASV-ASM)+BT]$$

where V is the volume of water, P is the weight of sand, K is a coefficient which varies between 0 and about 0.2 according to the nature of the sand, ASV is the contemplated degree of compactibility, ASM is the measured compactibility, BT is a correction factor for temperature and varies between 0 and about 2%, means for determining the quantity of bentonite which must be added to the spent sand for its regeneration, by calculating an index of cohesion Ic of the sand by means of the relation: $Ic=Rec/(ASM)$, where Rec is the compressive strength of the sand, ASM is the measured compactibility, said index Ic is compared with the contemplated index Ic and the quantity of bentonite required is determined so as to adjust the measured index Ic to the contemplated index Ic, and means for adding to the spent sand a quantity of water and bentonite as determined above.

3. An installation according to claim 2, wherein the means for measuring the compactibility of a sample of sand withdrawn from the pug mill comprises a cylinder in which is slidably mounted a piston actuated by a jack, means for introducing the sand to be tested into said cylinder, a cover actuated by a jack for closing the cylinder after filling said cylinder with sand to be tested and a transducer for measuring the travel of the piston within the cylinder which has been filed with the sand to be tested.

4. An installation according to claim 2, wherein the means for measuring the compressive strength of a sample of molding sand comprises a second piston disposed externally of the cylinder and capable of displacement along the axis of said cylinder toward the first piston, the end of said second piston being fitted with a force transducer.

* * * * *